US008175222B2

(12) United States Patent
Moore et al.

(10) Patent No.: US 8,175,222 B2
(45) Date of Patent: May 8, 2012

(54) ELECTRON EMITTER AND METHOD OF MAKING SAME

(75) Inventors: Paul D. Moore, Salt Lake City, UT (US); Stephen G. Bandy, Sunnyvale, CA (US); Clifford K. Nishimoto, San Jose, CA (US); David H. Humber, Los Gatos, CA (US); Gary F. Virshup, Cupertino, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 143 days.

(21) Appl. No.: 12/488,407

(22) Filed: Aug. 27, 2009

(65) Prior Publication Data

US 2011/0051898 A1 Mar. 3, 2011

(51) Int. Cl.
*H01J 35/00* (2006.01)

(52) U.S. Cl. ..... 378/136; 378/129

(58) Field of Classification Search ..... 378/136, 378/129, 119, 122, 134; 313/306, 341, 343, 313/344, 450, 454, 620, 621
See application file for complete search history.

(56) References Cited

U.S. PATENT DOCUMENTS

| | | | | |
|---|---|---|---|---|
| 2,076,527 | A * | 4/1937 | Corvington et al. | 315/65 |
| 7,693,265 | B2 * | 4/2010 | Hauttmann et al. | 378/136 |
| 2006/0001344 | A1 * | 1/2006 | Ohkubo et al. | 313/271 |
| 2007/0183577 | A1 * | 8/2007 | Arnold et al. | 378/136 |

* cited by examiner

*Primary Examiner* — Hoon Song
(74) *Attorney, Agent, or Firm* — Maschoff Gilmore & Israelsen

(57) ABSTRACT

One example embodiment includes an electron emitter. The electron emitter comprises a conductive member that defines a plurality of filament segments that are integral with each other. Each filament segment includes an intermediate portion and an interconnecting portion attached to an adjacent filament segment. The intermediate portions are substantially coplanar with each other and each intermediate portion includes a substantially planar electron emission surface.

19 Claims, 5 Drawing Sheets

ELECTRON EMITTER AND METHOD OF MAKING SAME

BACKGROUND OF THE INVENTION

1. The Field of the Invention

Embodiments of the present invention relate generally to x-ray devices. More particularly, embodiments of the present invention relate to electron emitters.

2. The Related Technology

The x-ray tube has become essential in medical diagnostic imaging, medical therapy, and various medical testing and material analysis industries. Such equipment is commonly employed in areas such as medical diagnostic examination, therapeutic radiology, semiconductor fabrication, and materials analysis.

An x-ray tube typically includes a vacuum enclosure that contains a cathode assembly and an anode assembly. The vacuum enclosure may be composed of metal such as copper, glass, ceramic, or a combination thereof, and is typically disposed within an outer housing. At least a portion of the outer housing may be covered with a shielding layer (composed of, for example, lead or a similar x-ray attenuating material) for preventing the escape of x-rays produced within the vacuum enclosure. In addition a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating the coolant to an external heat exchanger via a pump and fluid conduits. The cathode assembly generally consists of a metallic cathode head assembly and a source of electrons highly energized for generating x-rays. The anode assembly, which is generally manufactured from a refractory metal such as tungsten, includes a target surface that is oriented to receive electrons emitted by the cathode assembly.

During operation of the x-ray tube, the cathode is charged with a heating current that causes electrons to "boil" off the electron source or emitter by the process of thermionic emission. An electric potential on the order of about 4 kV to over about 160 kV is applied between the cathode and the anode in order to accelerate electrons boiled off the emitter toward the target surface of the anode. X-rays are generated when the highly accelerated electrons strike the target surface.

In order to produce high-quality x-ray images it is generally desirable to maximize both x-ray flux (i.e., the number of x-ray photons emitted per unit time) and x-ray beam focusing. An intense x-ray beam is useful for collecting high-contrast images in as short a period of time as possible, while the ability to distinguish between different structures in an x-ray image (e.g., a cancerous mass versus surrounding healthy tissue) is limited by x-ray beam focusing.

X-ray flux can be increased by increasing the number of electrons emitted by the emitter that impinge on the target surface. The number of electrons emitted by the emitter is a function of the area of the emitter and the temperature of the emitter. In general, raising the heating current increases the temperature of the emitter, the increase in temperature increasing the number of electrons emitted by the emitter. In turn, greater x-ray flux is produced when greater numbers of electrons strike the target surface.

While image contrast depends on electron flux, image quality (i.e., the ability to distinguish between different structures in an x-ray image) is a function of the focal spot created by the emitted beam of electrons on the target surface of the target anode. In general, a smaller focal spot produces a more highly focused or collimated beam of x-rays, and a more highly focused beam of x-rays produces better quality x-ray images.

Spiral filaments with circular profiles are problematic because the wide-range of initial trajectories of electrons emitted by such spiral filaments complicates the focusing structures required to focus the electrons into the focal spot on the target surface. Despite the use of such complicated focusing structures, the resulting focal spot still causes the anode to emit an x-ray beam with a double-peaked line shape function, which negatively affects image quality. Further, the resulting focal spot reduces the anode ratability (i.e., the heat input rate capability of the anode) compared to an ideal focal spot, thereby directly affecting the maximum x-ray flux that can be produced by the anode. Finally, the focusing structures for spiral filaments having circular profiles tend to over-focus some electrons, causing areas of x-ray intensity, referred to as "wings," in undesired locations of the emitted x-ray beam.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments of the invention relate to electron emitters.

One example embodiment includes an electron emitter. The electron emitter comprises a conductive member that defines a plurality of filament segments that are integral with each other. Each filament segment includes an intermediate portion and an interconnecting portion attached to an adjacent filament segment. The intermediate portions are substantially coplanar with each other and each intermediate portion includes a substantially planar electron emission surface.

Another example embodiment includes an x-ray tube comprising an evacuated enclosure, an electron emitter disposed within the evacuated enclosure, and an anode positioned within the evacuated enclosure so as to receive electrons emitted by the electron emitter. The electron emitter comprises a conductive member arranged in a spiral configuration having a profile with a substantially planar emitting side. The electron emitter further comprises a plurality of filament segments that are integral with each other and that are defined by the conductive member. Each filament segment includes an intermediate portion and an interconnecting portion attached to an adjacent filament segment. The filament segments are arranged such that the intermediate portions collectively define the substantially planar emitting side of the profile. The electron emitter further comprises substantially planar electron emission surfaces included on the intermediate portions.

Yet another example embodiment includes a method of forming an electron emitter, the method comprising winding a conductive member around a mandrel having a substantially planar side and forming a plurality of filament segments from the conductive member. Each filament segment includes an intermediate portion configured to emit electrons, the intermediate portions lying on the substantially planar side of the mandrel. The method further includes stress relieving and setting the profile of the electron emitter to substantially match the profile of the first mandrel and forming a substantially planar electron emission surface on each intermediate portion.

Yet another example embodiment includes a method of forming an electron emitter. The method comprises winding a conductive member around a mandrel having a curved profile. The wound conductive member defines a plurality of filament segments that are integral with each other and are arranged in a spiral having a curved profile. Each filament segment includes an intermediate portion configured to emit electrons. The method further comprises removing the mandrel from the spiral and deforming the spiral to form a substantially planar emitting side, the substantially planar emitting side including the intermediate portions. The method further includes stress relieving and setting the deformed profile of the spiral and forming a substantially planar electron emission surface on each intermediate portion.

These and other aspects of example embodiments of the invention will become more fully apparent from the following description and appended claims.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Embodiments of the present invention are generally directed to a thermionic emitter used to emit electrons for use in the production of x-rays. Some example embodiments include an electron emitter designed to emit a substantially collimated beam of electrons. Emitting a substantially collimated beam of electrons allows shaping of the focal spot profile of the beam of electrons to the most advantageous Modulation Transfer Function ("MTF") and line shape function for improved imaging and ratability of the resulting focal spot.

I. X-Ray Devices

Figure 1:
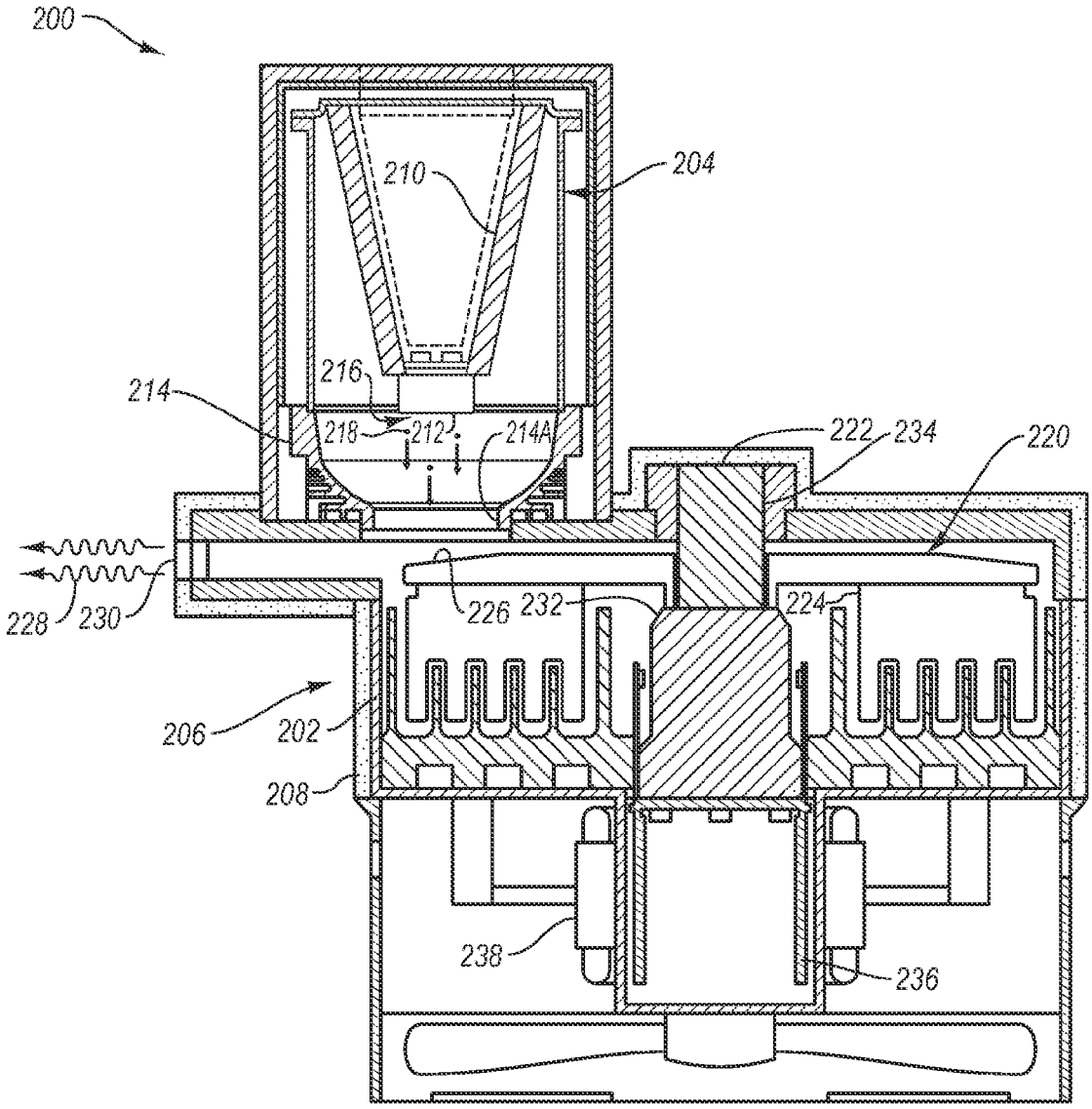
FIG. 1 illustrates a simplified cross-sectional side view of an x-ray tube that serves as one possible environment for employment of some embodiments of the invention.

Reference is first made to FIG. 1, which depicts one possible environment wherein embodiments of the present invention can be practiced. Particularly, FIG. 1 shows an x-ray tube, designated generally at 200, which serves as one example of an x-ray generating device. The x-ray tube 200 generally includes an evacuated enclosure 202 that houses a cathode assembly 204 and an anode assembly 206. The evacuated enclosure 202 defines and provides the necessary envelope for housing the cathode and anode assemblies 204, 206 and other critical components of the x-ray tube 200 while providing the shielding and cooling necessary for proper x-ray tube 200 operation. The evacuated enclosure 202 further includes shielding 208 that is positioned so as to prevent unintended x-ray emission from the x-ray tube 200 during operation. Note that, in other embodiments, the x-ray shielding 208 is not included with the evacuated enclosure 202, but rather might be joined to a separate outer housing that envelops the evacuated enclosure 202. In yet other embodiments, the x-ray shielding 208 may be included neither with the evacuated enclosure 202 nor the outer housing, but may be included in another predetermined location.

In greater detail, the cathode assembly 204 is responsible for supplying a stream of electrons for producing x-rays, as previously described. While other configurations could be used, in the illustrated example, the cathode assembly 204 includes a support structure 210 that supports a cathode head 212. In the example of FIG. 1, a cathode aperture shield 214 defines an aperture 214A that is positioned between an electron emitter 216 of the cathode head 212 and the anode assembly 206 to allow electrons 218 emitted from the electron emitter 216 to pass. The cathode aperture shield 214 in one embodiment can be cooled by a cooling fluid as part of a tube cooling system (not shown) in order to remove heat that is created in the cathode aperture shield 214 as a result of errant electrons impacting the surface of the cathode aperture shield 214.

FIG. 1 discloses one example environment in which an electron emitter 216 according to embodiments of the invention might be utilized. However, it will be appreciated that there are many other x-ray tube configurations and environments for which embodiments of the electron emitter 216 would find use and application.

As mentioned, the cathode head 212 includes the electron emitter 216 as an electron source for the production of the electrons 218 during operation of x-ray tube 200. As such, the electron emitter 216 is appropriately connected to an electrical power source (not shown) to enable the production by the electron emitter 216 of the electrons generally designated at 218.

The anode assembly 206 includes an anode 220 and an anode support assembly 222. The anode 220 comprises a substrate 224 that may be composed of graphite, and a target surface 226 disposed on the anode 220. In some embodiments, the target surface 226 comprises tungsten or tungsten-rhenium, although it will be appreciated that depending on the application, other "high" Z materials/alloys might be used. A predetermined portion of the target surface 226 is positioned such that the stream of electrons 218 emitted by the electron emitter 216 and passed through the aperture 214A impinge on the target surface 226 so as to produce x-rays 228 for emission from the evacuated enclosure 202 via an x-ray transmissive window 230.

The anode 220 is rotatably supported by the anode support assembly 222. The anode support assembly generally comprises a bearing assembly 232, a support shaft 234, and a rotor sleeve 236. The support shaft 234 is fixedly attached to a portion of the evacuated enclosure 202 such that the anode 220 is rotatably supported by the support shaft 234 via the bearing assembly 232, thereby enabling the anode 220 to rotate with respect to the support shaft 234. A stator 238 is disposed about the rotor sleeve 236 and utilizes rotational electromagnetic fields to cause the rotor sleeve 236 to rotate. The rotor sleeve 236 is attached to the anode 220, thereby providing the needed rotation of the anode 220 during x-ray tube 200 operation. Again, it should be appreciated that embodiments of the present invention can be practiced with anode assemblies having configurations that differ from that described herein. Moreover, in still other x-ray device implementations and applications, the anode may be stationary.

II. Electron Emitters

According to embodiments of the invention, the electron emitter 216 is configured to emit a substantially collimated electron beam. The substantially collimated electron beam can be easily focused into a focal spot on the anode 220 that generates an x-ray beam with a single-peak line shape function, improved ratability, and minimal, or no, wings. Various example electron emitters that may correspond to the electron emitter 216 of FIG. 1 will now be disclosed with respect to FIGS. 2A-6.

A. Trilobed Spiral Electron Emitter

Figure 2A:
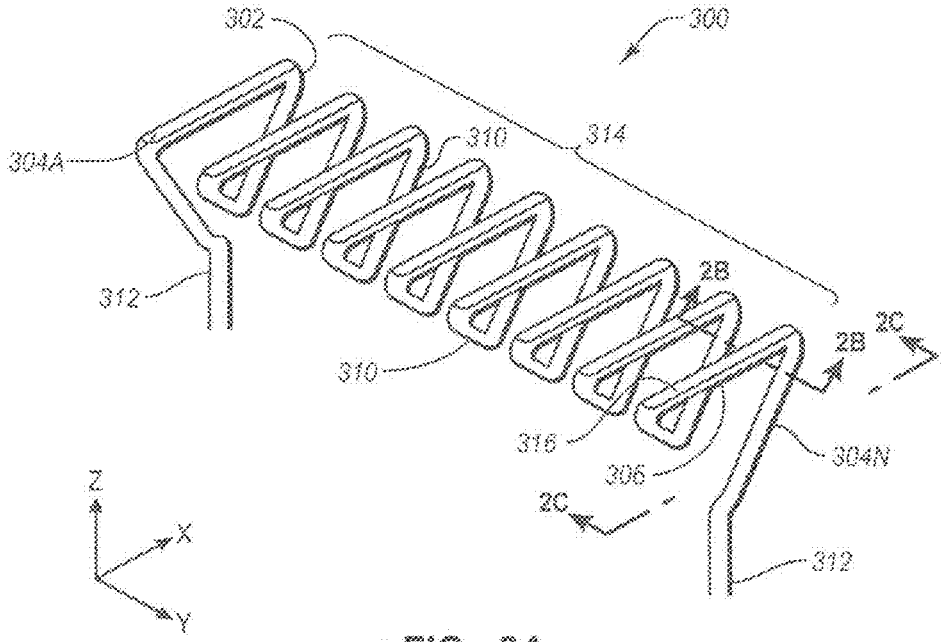
FIG. 2A is a perspective view of one example electron emitter that can be implemented in devices such as the x-ray tube of FIG. 1.

Aspects of one example electron emitter 300 configured to generate a substantially collimated electron beam will first be described with respect to FIGS. 2A-2C. As shown in FIG. 2A, the electron emitter 300 includes conductive member 302 that defines a plurality of integral filament segments 304A-304N. Each of filament segments 304A-304N includes an intermediate portion 306 configured to emit electrons. Each of filament segments 304A-304N further includes interconnecting portions 310 attached to adjacent filament segments 304A-304N. Each end of the conductive member 302 defines a terminal 312 for electrically connecting the electron emitter 300 to a power source (not shown).

Figure 2D:
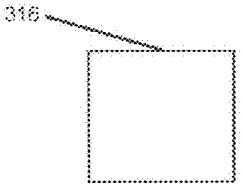
FIGS. 2B and 2D are cross-sectional views of the intermediate portion that can be included in the example electron emitter of FIG. 2A.
Figure 2B:
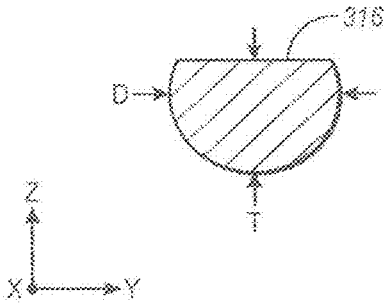
Figure 2C:
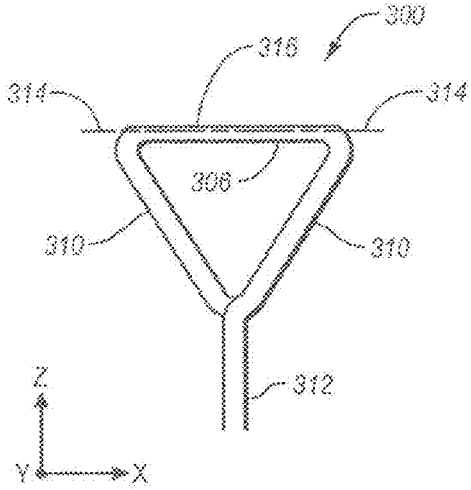
FIG. 2C is an end view of the example electron emitter of FIG. 2A.

In the embodiment disclosed in FIGS. 2A-2C, the electron emitter 300 includes a substantially planar emitting side 314 collectively defined by the intermediate portions 306. In FIG. 2A, the substantially planar emitting side 314 is substantially parallel to the arbitrarily defined x-y plane and is configured to be disposed opposite the anode 220 of FIG. 1 when implemented in x-ray tube 200.

Generally speaking, electrons emitted by an electron emitter tend to be emitted with initial trajectories that are substantially normal to the emitting surface of the electron emitter. Among other things, the substantially planar emitting side 314 of electron emitter 300 is accordingly configured to enable the electron emitter 300 to emit electrons with initial trajectories that are substantially parallel to the arbitrarily defined y-z plane.

In addition, each intermediate portion 306 includes a substantially planar electron emission surface 316, as best seen in the cross-sectional view of intermediate portion 306 in FIG. 2B or FIG. 2D. As used herein, the term "substantially planar electron emission surface" is to be broadly construed to refer to any electron emission surface that is between slightly concave and slightly convex, including completely planar. For instance, the intermediate portions 306 of electron emitter 300 have substantially planar electron emission surfaces 316 that may be completely planar as depicted in FIGS. 2A-2C. Alternately, electron emitters according to embodiments of the invention can have "substantially planar electron emission surfaces" that are slightly concave, examples of which are disclosed in U.S. Patent Publication 2007/0183577, published Aug. 9, 2007, and entitled "CATHODE STRUCTURES FOR X-RAY TUBES," which publication is herein incorporated by reference in its entirety. Alternately, electron emitters according to embodiments of the invention can have "substantially planar electron emission surfaces" that are slightly convex.

In this and some other embodiments, the combination of the substantially planar emitting side 314 with the substantially planar electron emission surfaces 316 enable the electron emitter 300 to emit a substantially collimated beam of electrons. Accordingly, the electron emitter 300 is configured to emit electrons with initial trajectories that are substantially parallel to the z-axis.

In some embodiments, the conductive member 302 utilized to form the electron emitter 300 inherently includes one or more substantially planar surfaces that may correspond to the substantially planar electron emission surfaces 316. For instance, the conductive member 302 may comprise ribbon wire or wire having a square, rectangular, oval or elliptical cross-section.

Alternately, the conductive member 302 may comprise wire having a substantially circular cross-section along at least some portions of the electron emitter 300, such as along the interconnecting portions 310 and terminals 312, as shown in FIG. 2A. In the example of FIGS. 2A-2C, substantially planar electron emission surfaces 316 are situated on the intermediate portions 306 of conductive member 302 on the substantially planar emitting side 314 of electron emitter 300. During manufacture of the electron emitter 300, the intermediate portions 306 may initially have substantially circular cross-sections prior to formation of the substantially planar electron emission surfaces 316 on the intermediate portions 306. The substantially planar electron emission surfaces 316 can be formed on the intermediate portions 306 using one or more of electrical discharge machining ("EDM"), etching, grinding, or any combination thereof.

As shown in FIG. 2B, the intermediate portions 306 may have a semicircular cross-section after formation of the substantially planar electron emission surfaces 316, the flat side of the semicircular cross-section corresponding to the substantially planar electron emission surfaces 316. In some embodiments, the thickness T of the intermediate portion 306 is between 50% and 70% of the diameter D of the intermediate portion 306. Alternately or additionally, the thickness T may be greater than 70% or less than 50% of the diameter D of the intermediate portion 306. As used herein, the thickness T of an intermediate portion with a semicircular cross-section refers to the length of a line segment that substantially evenly bisects the semicircular cross-section. The diameter D of an intermediate portion with a semicircular cross-section refers to the diameter of a circle having the same radius of curvature as the curved portions of the semicircular cross-section. As shown in FIG. 2D, the intermediate portions 306 may have a rectangular cross-section, an upper flat side of the rectangular cross-section corresponding to the substantially planar electron emission surfaces 316.

In this and other embodiments, when the conductive member 302 comprises wire initially having a substantially circular cross-section, formation of the substantially planar electron emission surfaces 316 by flattening the conductive member 302 in the intermediate portions 306 can facilitate rapid cooling of the electron emitter 300 provided the cooling is primarily radiative (as opposed to conductive). More particularly, flattening of the conductive member 302 at the intermediate portions 306 to form the substantially planar electron emission surfaces 316 can reduce the thermal mass per emitting area of the electron emitter 300. As a result, the electron emitter 300 can dissipate heat more quickly than, e.g. an electron emitter having intermediate portions with circular cross-sections.

Alternately or additionally, flattening of the conductive member 302 at the intermediate portions 306 can substantially maintain the stiffness of the electron emitter 300 at the interconnecting portions 310 and/or terminals 312 while still providing reduced thermal mass per emitting area of the electron emitter 300. Maintaining the stiffness of the electron emitter 300 at the interconnecting portions 310 and/or terminals 312 can be useful in, e.g., rotating applications such as CT gantry applications where rotational motion around the CT gantry can cause an electron emitter to flex and bend enough to negatively affect the emitted electron beam unless the electron emitter is sufficiently stiff.

Returning to FIG. 2A, the filament segments 304A-304N are arranged in a spiral configuration having a trilobed profile. As used herein, "profile" refers to the shape of the spiral or an associated mandrel as viewed from one end of the filament or the mandrel. A "trilobed" profile refers to a substantially triangular profile where the three corners of the triangular profile are partially rounded into three lobes. For instance, FIG. 2C is a profile view of the electron emitter 300 as viewed from one end of the electron emitter 300, e.g. with filament segment 304N in front and the remaining filament segments lined up behind filament segment 304N. As can be seen from FIG. 2C, the profile of electron emitter 300 includes three partially rounded corners or lobes; as such, the profile of the electron emitter 300 can be described as a trilobed profile.

Figure 3:
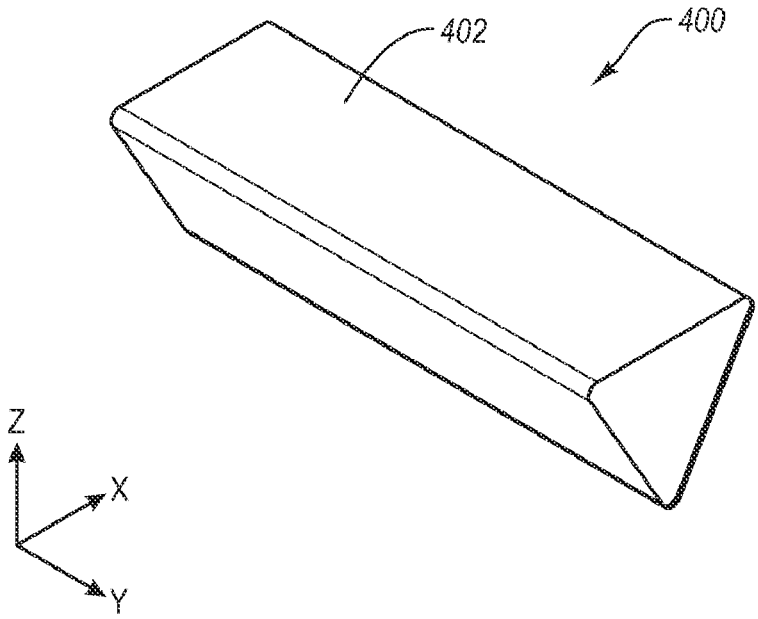
FIG. 3 is a perspective view of one example mandrel that can be employed to form the example electron emitter of FIG. 2A.

With combined reference to FIGS. 2A-3, one embodiment of a method and device for forming an electron emitter configured to emit a substantially collimated beam of electrons, such as electron emitter 300, is disclosed. The method begins after obtaining a mandrel having at least one substantially planar side, such as a trilobed mandrel 400 of FIG. 3 having substantially planar side 402. The conductive member 302 is wound around the trilobed mandrel 400 to form filament segments 304A-304N. Because the trilobed mandrel 400 includes substantially planar side 402, the intermediate portions 306 of each filament segment 304A-304N lying on the substantially planar side 402 of trilobed mandrel 400 are substantially coplanar.

After winding the conductive member 302 around the trilobed mandrel 400, the conductive member 302 can be recrystallized or flashed to stress relieve and set the profile of the electron emitter to substantially match the profile of the mandrel.

Following recrystallization, the intermediate portions 306 lying on the substantially planar side 402 are flattened using any suitable method, such as EDM, etching, or grinding, to form a substantially planar electron emission surface 316 on each intermediate portion 306. The intermediate portions 306 can be flattened after removing the trilobed mandrel 400 from the center of the electron emitter 300 or before the trilobed mandrel 400 is removed.

If the conductive member 302 comprises ribbon wire or wire having a square, rectangular, oval or elliptical cross-section, the step of flattening the intermediate portions 306 lying on the substantially planar side 402 can be omitted. Instead, the substantially planar electron emission surfaces 316 can be formed on the intermediate portions 306 by winding a conductive member 302 comprising ribbon wire or wire having a square or rectangular cross-section around the mandrel 400. In this case, the conductive member 302 comprising ribbon wire or wire having a square or rectangular cross-section inherently includes one or more substantially planar surfaces and the act of winding the conductive member 302 around the mandrel 400 results in formation of the substantially planar electron emission surfaces 316 on the intermediate portions 306.

Optionally, as will be described in greater detail below, formation of the electron emitter 300 can further implement various techniques, such as selective carburization, to reduce the work function and emitting temperature of the electron emitter 300.

In operation, the electron emitter 300 and the other example electron emitters described herein can be heated to emission temperature using a variety of methods. For instance, an electric current can be applied to the electron emitter 300 via terminals 312 with the trilobed mandrel 400 removed, the electric current heating the electron emitter 300 to a temperature sufficient to cause the electron emitter 300 to emit electrons. Alternately, with the trilobed mandrel 400 still in place in the electron emitter 300, current can be applied to the trilobed mandrel 400, the electric current heating up the trilobed mandrel, and the trilobed mandrel heating up the electron emitter 300. Alternatively, the trilobed mandrel 400 can be replaced by a smaller refractory mandrel and current applied to the smaller refractory mandrel, the electric current heating up the smaller refractory mandrel, and the smaller refractory mandrel emanating heat to warm up the electron emitter 300. While various electron emitter heating methods have been described, embodiments of the invention are not limited to any particular one and may include other heating methods now known or later developed.

B. Other Spiral Electron Emitters

FIGS. 2A-2C disclose one example electron emitter configured to generate a substantially collimated electron beam. The electron emitter 300 is arranged in a spiral configuration having a trilobed profile. However, embodiments of the invention are not limited to spiral-configured electron emitters having trilobed profiles.

Figure 4:
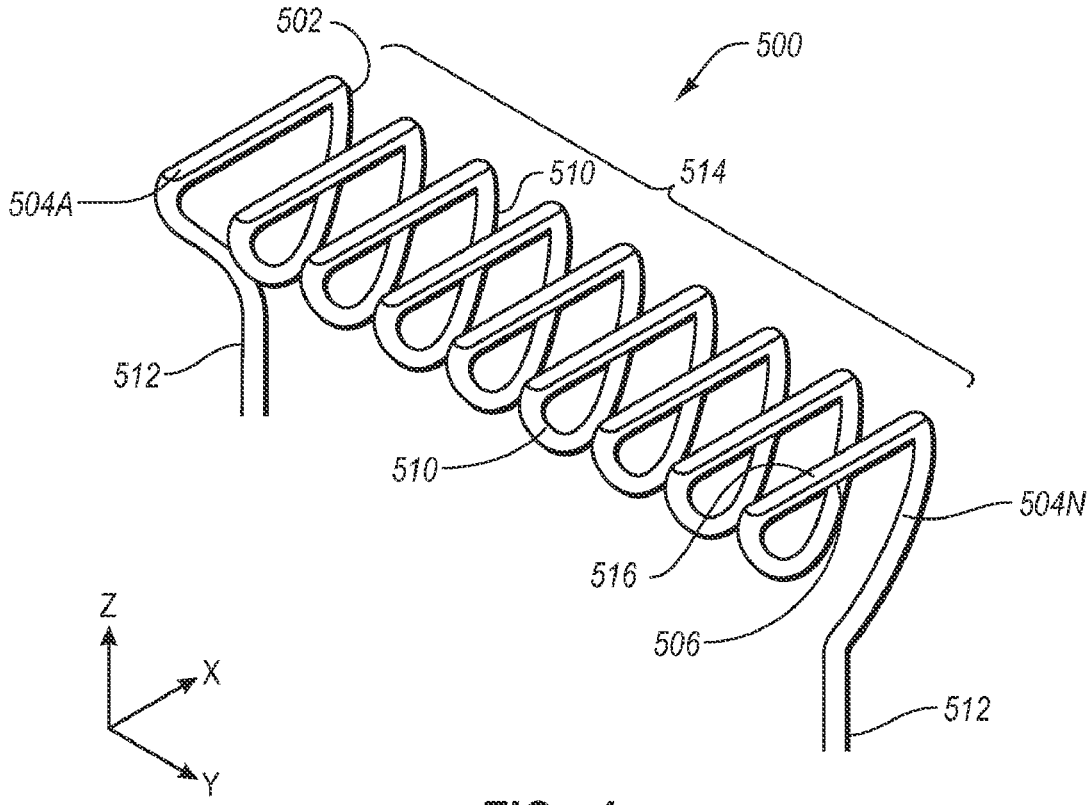
FIG. 4 is a perspective view of a second example electron emitter that can be implemented in devices such as the x-ray tube of FIG. 1.

For instance, FIG. 4 discloses an electron emitter 500 configured to generate a substantially collimated electron beam, the electron emitter 500 arranged in a spiral configuration having a substantially semicircular profile. The electron emitter 500 includes a conductive member 502 that defines a plurality of integral filament segments 504A-504N. Each of filament segments 504A-504N includes an intermediate portion 506 configured to emit electrons. Each of filament segments 504A-504N further includes interconnecting portions 510 attached to adjacent filament segments 504A-504N. Each end of the conductive member 502 defines a terminal 512 for electrically connecting the electron emitter 500 to a power source (not shown).

The electron emitter 500 further includes a substantially planar emitting side 514 collectively defined by intermediate portions 506, the intermediate portions 506 being substantially coplanar. Each intermediate portion 506 includes a substantially planar electron emission surface 516. The conductive member 502 can inherently include one or more substantially planar surfaces corresponding to the substantially planar electron emission surfaces 516, as in the case of a conductive member having a rectangular cross-section, or the intermediate portions 506 of the conductive member 502 can be flattened as described above to form the substantially planar electron emission surfaces 516.

According to some embodiments of the invention, the electron emitter 500 can be formed using a similar method as described above with respect to electron emitter 300, except that a semicircular mandrel is used in place of the trilobed mandrel 400.

FIGS. 2A-2C and 4 disclose two different spiral-configured electron emitters 300 and 500 configured to generate a substantially collimated electron beam, the electron emitter 300 having a trilobed profile and the electron emitter 500 having a substantially semicircular profile. Spiral-configured electron emitters having other profiles with a substantially planar emitting side can alternately or additionally be implemented to generate a substantially collimated electron beam according to embodiments of the invention. For instance, embodiments of the invention include spiral-configured electron emitters having trilobed profiles, elliptical profiles, rectangular profiles, semicircular profiles, square profiles, pentagonal profiles, other polygonal profiles, or the like or any combination thereof Such spiral-configured electron emitters can be formed as explained above with respect to FIGS. 2A-3 by starting with an appropriately shaped mandrel that includes a substantially planar side.

Alternately or additionally, such spiral-configured electron emitters can be formed by starting with a mandrel having a completely curved profile, e.g., circular, elliptical, or the like. As used herein, a "mandrel having a completely curved profile" refers to a mandrel that lacks at least one substantially planar side. A conductive member is wound around the mandrel to form a plurality of filament segments. The mandrel is removed and the spiral-configured electron emitter is deformed to form a substantially planar emitting side. If the conductive member comprises wire having a circular cross-section, the portions of the conductive member lying in the newly formed substantially planar emitting side can be flattened to form substantially planar electron emission surfaces as described above.

Figure 5C:
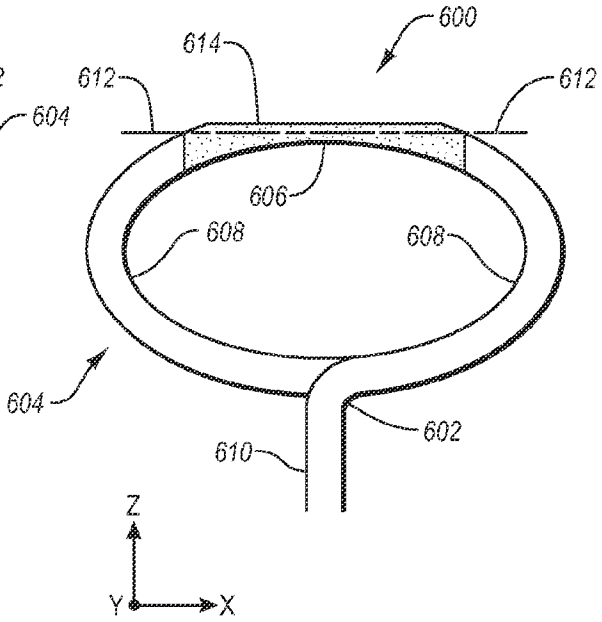
FIGS. 5A-5C illustrate aspects of a method of forming a third example electron emitter that can be implemented in devices such as the x-ray tube of FIG. 1.
Figure 5B:
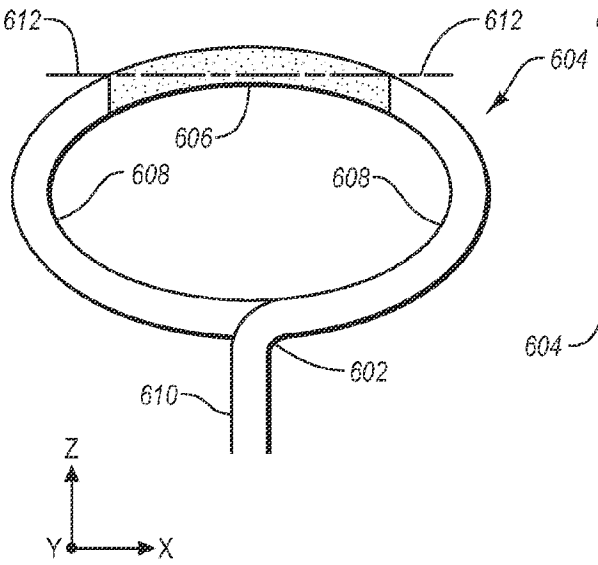
Figure 5A:
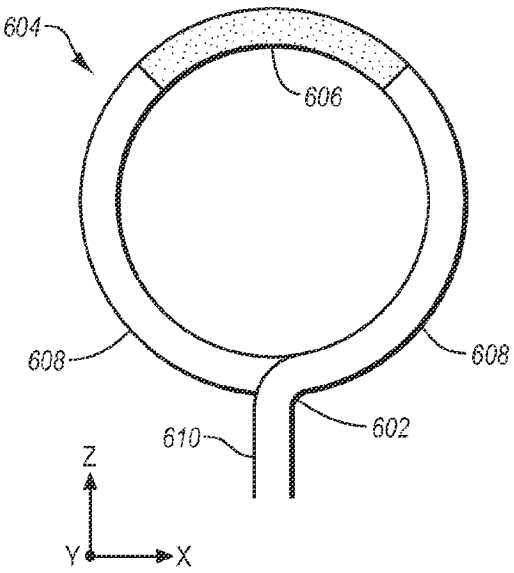
Figure 6:
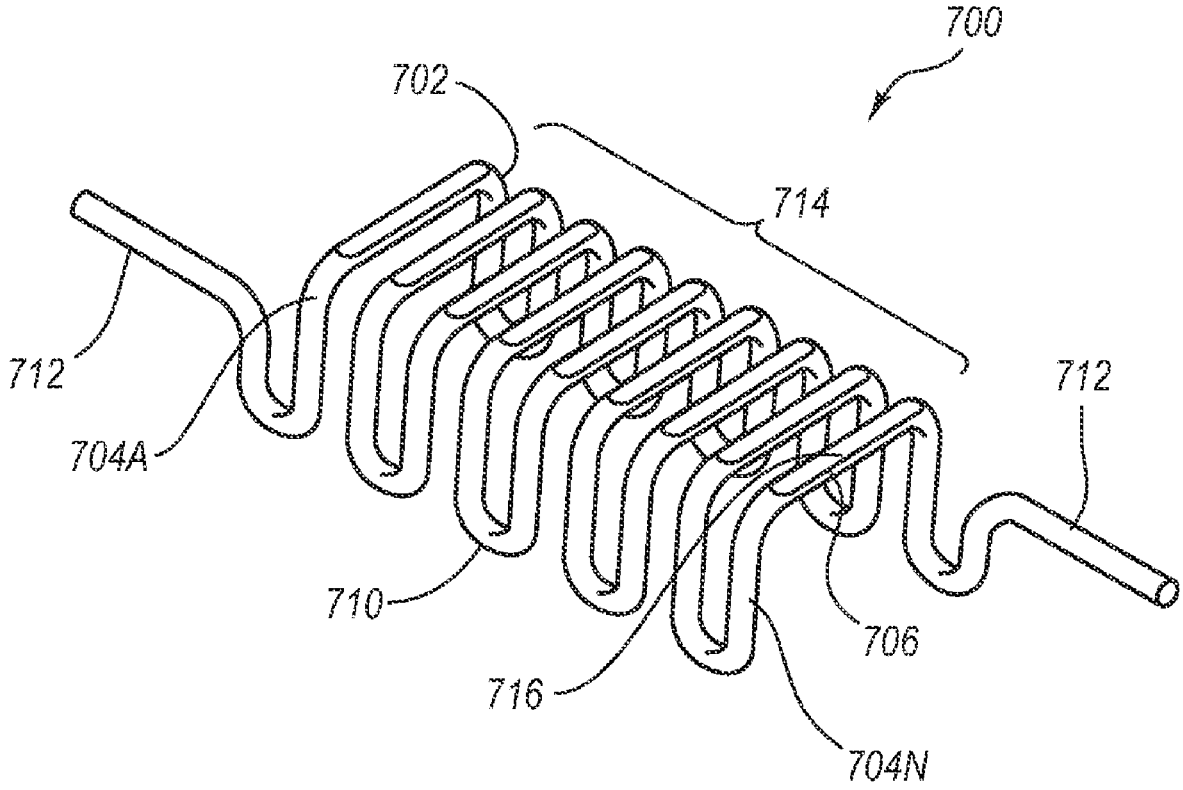
FIG. 6 is a perspective view of a fourth example electron emitter that can be implemented in devices such as the x-ray tube of FIG. 1.

As an example, FIGS. 5A-5C disclose an alternative embodiment of a method for forming an electron emitter according to embodiments of the invention using a mandrel having a completely curved profile. As shown, FIGS. 5A-5C illustrate simplified profile views of a spiral-configured electron emitter at various stages of formation.

The method begins after obtaining a mandrel having a completely curved profile, such as a mandrel having a circular profile in this example. A conductive member 602 is wound around the circular mandrel, the wound conductive member 602 defining a plurality of integral filament segments 604 arranged in a spiral configuration having a circular profile, as shown in FIG. 5A. Note that only one of the filament segments 604 is visible in the profile views of FIGS. 5A-5C. Each filament segment 604 includes an intermediate portion 606 configured to emit electrons and interconnecting portions 608 interconnecting adjacent filament segments 604. Each end of the conductive member 602 defines a terminal 610 for electrically connecting the resulting electron emitter 600 (FIG. 5C) to a power source (not shown).

After the conductive member 602 has been wound around the circular mandrel in a spiral configured with a circular profile, the mandrel is removed and the spiral is smashed or otherwise deformed to form substantially planar emitting side 612, represented in FIGS. 5B and 5C by reference plane 612. As used herein, the term "substantially planar emitting side" is to be broadly construed to refer to any emitting side that is between slightly concave and slightly convex, including completely planar. For instance, the electron emitters 300 and 500 of FIGS. 2A-2C and 4 have substantially planar emitting sides 314, 514 that are relatively closer to being completely planar than the substantially planar emitting side 612 of FIG. 5B. In contrast, the conductive member 602 of FIG. 5B has a substantially planar emitting side 612 that is slightly convex.

Returning to FIG. 5B, the substantially planar emitting side 612 includes the intermediate portions 606. After the spiral has been deformed, the intermediate portions 606 are substantially coplanar due to the formation of the substantially planar emitting side 612. At this point, the conductive member 602 can be recrystallized or flashed to stress relieve and set the deformed profile.

Finally, as shown in FIG. 5C, each intermediate portion 606 can be flattened to form a substantially planar electron emission surface 614 on each intermediate portion 606. The step of flattening each intermediate portion 606 to form substantially planar electron emission surfaces 614 can be omitted if the conductive member 602 inherently includes one or more substantially planar surfaces, in which case the substantially planar electron emission surfaces 614 are formed by the acts of winding the conductive member 602 around the mandrel and deforming the resulting spiral. The resulting electron emitter 600 shown in FIG. 5C has a spiral configuration with a quasi-elliptical profile.

C. Non-Spiral Electron Emitters

Embodiments of the invention are not limited to electron emitters arranged in a spiral configuration. Indeed, embodiments of the invention contemplate virtually any electron emitter configuration, including or in addition to spiral configurations, having a plurality of filament segments with substantially coplanar intermediate portions, the intermediate portions having substantially planar emitting surfaces. One example having a non-spiral configuration is disclosed in FIG. 6 as electron emitter 700.

Similar to the electron emitters 300, 500, 600 described above, the electron emitter 700 of FIG. 6 includes a conductive member 702 that defines a plurality of integral filament segments 704A-704N. Each filament segment 704A-704N includes an electron-emitting intermediate portion 706. Each filament segment 704A-704N further includes interconnecting portions 710 attached to adjacent filament segments 704A-704N. Each end of the conductive member 702 defines a terminal 712 for electrically connecting the electron emitter 700 to a power source (not shown). In contrast to the electron emitters 300, 500, 600 of FIGS. 2A-5C, however, the electron emitter 700 is arranged in a ladder-type configuration, rather than a spiral configuration.

The electron emitter 700 further includes a substantially planar emitting side 714 defined by intermediate portions 706, the intermediate portions 706 being substantially coplanar. Each intermediate portion 706 includes a substantially planar electron emission surface 716. The conductive member 702 can inherently include one or more substantially planar surfaces corresponding to the substantially planar electron emission surfaces 716 or the intermediate portions 706 of the conductive member 702 can be flattened to form the substantially planar electron emission surfaces 716 using EDM, etching, grinding, or the like or any combination thereof.

D. Aspects of Some Conductive Members

The conductive members 302, 502, 602, 702 used to form the electron emitters 300, 500, 600, 700 according to embodiments of the invention can comprise ribbon wire or wire having a square, rectangular, polygonal, oval, elliptical or circular cross-section, or the like. Further, the conductive members 302, 502, 602, 702 can comprise any one or more of a variety of materials and/or can be treated using any one or more of a variety of techniques to optimize the performance of the electron emitters 300, 500, 600, 700.

For example, in some embodiments, the conductive members 302, 502, 602, 702 comprise tungsten or tungsten-rhenium. In this example, the conductive members 302, 502, 602, 702 can optionally be coated with an insulating material prior to forming the substantially planar electron emission surfaces 316, 516, 614, 716. Optionally, the insulating material can remain on the surface of the conductive members 302, 502, 602, 702 during the life of the electron emitters 300, 500, 600, 700.

In some embodiments of the invention, it may be desirable to alter the work function value of the conductive members 302, 502, 602, 702 to affect electron emission. For example, it may be desirable to fabricate the electron emitters 300, 500, 600, 700 using conductive members 302, 502, 602, 702 comprising thorium-doped tungsten ("thoriated tungsten"). Thoriated tungsten has a work function value of about 2.7 eV versus 4.55 eV for pure tungsten. A lower work function value means, for example, that an electron emitter fabricated from thoriated tungsten will emit electrons more readily than a material with a higher work function value, such as tungsten. One will therefore appreciate that altering the work function value of the material used to fabricate the electron emitters 300, 500, 600, 700 is one way that electron emission from the electron emitters 300, 500, 600, 700 can be controlled. Other possible materials might include, for example, lanthanated tungsten, hafnium, hafnium carbide, lanthanum hexaboride, and combinations of these or similar materials.

In some embodiments of the invention, the conductive member 302, 502, 602, 702 further includes a carbon dopant. Carbon doping ("carburization") of an electron emitter made from a conductive member is typically achieved by subjecting the completed electron emitter to a heat treatment in a hydrocarbon atmosphere consisting of a hydrogen carrier gas and benzene, naphthalene acetylene, xylene, or methane. The heat treatment can include heating the conductive member 302, 502, 602, 702 by applying electric current to the conductive member 302, 502, 602, 702 via terminals 312, 512, 610, 712 with an associated mandrel removed from the electron emitter 300, 500, 600, 700, or heating the conductive member 302, 502, 602, 702 by leaving the associated mandrel in place in the electron emitter 300, 500, 600, 700 and applying electric current to the mandrel, or heating the conductive member 302, 502, 602, 702 by replacing the associated mandrel with a smaller refractory mandrel and applying current to the smaller refractory mandrel, or heating the conductive member 302, 502, 602, 702 using any other method now known or later developed.

When the electron emitter, including thoriated tungsten, for example, is heated in the presence of the hydrocarbon to a temperature on the order of 2000° C., the hydrocarbon is decomposed at the hot surface to form a carbide that diffuses into the electron emitter. Inclusion of the carbon dopant alters the work function of the electron emitter. The altered work function alters the temperature-dependent electron emission profile of the electron emitter. In addition, carburization significantly increases the useful lifespan of an electron emitter fabricated from thoriated metal by reducing the rate of thorium evaporation from the electron emitter.

In some embodiments, the conductive members 302, 502, 602, 702 are selectively carburized at the substantially planar electron emission surfaces 316, 516, 614, 716. For instance, the conductive members 302, 502, 602, 702 can comprise thoriated tungsten wire coated with an insulating material. During formation of the substantially planar electron emission surfaces 316, 516, 614, 716, the insulating material is removed from the conductive members 302, 502, 602, 702 in the area of the substantially planar electron emission surfaces 316, 516, 614, 716. The newly exposed substantially planar electron emission surfaces 316, 516, 614, 716 can then be carburized as explained above. Carburization of the conductive members 302, 502, 602, 702 results in selective carburization of the conductive members 302, 502, 602, 702 at the substantially planar electron emission surfaces 316, 516, 614, 716 since the insulating material coating the rest of the conductive members 302, 502, 602, 702 substantially prevents carburization of the rest of the conductive members 302, 502, 602, 702. The selective carburization lowers the work function value of the substantially planar electron emission surfaces 316, 516, 614, 716 relative to the rest of the conductive member 302, 502, 602, 702. In this embodiment, the insulating material can be removed from the rest of the conductive member 302, 502, 602, 702 after carburizing the substantially planar electron emission surfaces 316, 516, 614, 716.

Alternately, the conductive members 302, 502, 602, 702 can be selectively carburized without the use of an insulating material. For instance, after formation of the substantially planar electron emission surfaces 316, 516, 614, 716, they can be brought into contact with one or more substantially planar carbon sources in an oven. Such a configuration effectively localizes carburization of the conductive member 302, 502, 602, 702 to the areas of contact—e.g. the substantially planar electron emission surfaces 316, 516, 614, 716—between the conductive member 302, 502, 602, 702 and the substantially planar carbon sources.

In summary, embodiments of the invention include electron emitters configured to emit a substantially collimated beam of electrons, the electron emitters comprising a plurality of filament segments with substantially coplanar intermediate portions, the intermediate portions having substantially planar electron emitting surfaces. Embodiments of the invention are not limited to any particular configuration of filament segments and include filament segments arranged in spiral configurations, ladder configurations, and the like.

Further, embodiments of the invention are not limited to any particular electron emitter profile. For instance, embodiments of the invention include electron emitters having trilobed profiles, semicircular profiles, quasi-elliptical profiles, and virtually any other profile having at least one substantially planar emitting side.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An electron emitter comprising:

a conductive member that defines a plurality of filament segments that are integral with each other, each filament segment including an intermediate portion and an interconnecting portion attached to an adjacent filament segment;

wherein:

the intermediate portions are substantially coplanar with each other;

each intermediate portion includes a substantially planar electron emission surface; and the plurality of filament segments are arranged in a ladder-type configuration with a substantially planar emitting side collectively defined by the substantially coplanar intermediate portions.

2. The electron emitter of claim 1, wherein the conductive member comprises a ribbon wire or a wire having a square or rectangular cross-section.

3. The electron emitter of claim 1, wherein the conductive member comprises one or more selectively carburized thoriated tungsten regions.

4. The electron emitter of claim 3, wherein the selectively carburized thoriated tungsten regions coincide with the substantially planar electron emission surfaces.

5. The electron emitter of claim 1, wherein the plurality of filament segments are arranged in a spiral configuration having a substantially semicircular profile, a substantially planar emitting side of the semicircular profile collectively defined by the substantially coplanar intermediate portions.

6. The electron emitter of claim 1, wherein the plurality of filament segments are arranged in a spiral configuration having a quasi-elliptical profile with a substantially planar emitting side that includes the substantially coplanar intermediate portions.

7. The electron emitter of claim 1, wherein the conductive member comprises a wire having a substantially circular cross-section except where the substantially planar electron emission surfaces are formed in the intermediate portions of the wire, the intermediate portions of the wire having a substantially semicircular cross-section.

8. The electron emitter of claim 7, wherein the thickness of each intermediate portion is between 50% and 70% of the diameter of the circular cross-section.

9. An x-ray tube, comprising:

an evacuated enclosure;

an electron emitter disposed within the evacuated enclosure, the electron emitter comprising:

a conductive member arranged in a spiral configuration having a profile with a substantially planar emitting side;

a plurality of filament segments that are integral with each other and that are defined by the conductive member, each filament segment including an intermediate portion and an interconnecting portion attached to an adjacent filament segment, the filament segments being arranged such that the intermediate portions collectively define the substantially planar emitting side of the profile, wherein the plurality of filament segments are arranged in a spiral configuration having a trilobed profile with the substantially planar electron emission surface on each intermediate portion collectively defined by the substantially planar intermediate portions; and a substantially planar electron emission surface included on each intermediate portion; and an anode positioned within the evacuated enclosure so as to receive electrons emitted by the electron emitter.

10. The electron emitter of claim 9, wherein the conductive member comprises one or more of: tungsten, tungsten-rhenium, lanthanated tungsten, hafnium, hafnium carbide, lanthanum hexaboride, or thoriated tungsten.

11. The electron emitter of claim 9, wherein the substantially planar emitting side and the substantially planar electron emission surfaces enable the electron emitter to emit a substantially collimated beam of electrons.

12. The electron emitter of claim 1, wherein each filament segment further comprises a first end and a second end, wherein the first end is disposed opposite the second end.

13. The electron emitter of claim 12, wherein the ladder-type configuration is defined by the interconnecting portion attaching to an adjacent filament segment by connecting the second end of the filament segment to the second end of the adjacent filament segment.

14. The electron emitter of claim 9, wherein each filament segment further comprises a first end and a second end disposed opposite the first end.

15. The electron emitter of claim 14, wherein the spiral configuration having a trilobed is defined by the interconnecting portion attaching to an adjacent filament segment by connecting the second end of the filament segment to the first end of the adjacent filament segment.

16. The electron emitter of claim 9, wherein the spiral configuration having a trilobed profile defines the shape of the spiral as viewed from one end of the filament being substantially triangular having three corners rounded into three lobes.

17. An electron emitter comprising:

a conductive member that defines a plurality of filament segments that are integral with each other, each filament segment including an intermediate portion and an interconnecting portion attached to an adjacent filament segment;

wherein:

the intermediate portions are substantially coplanar with each other;

each intermediate portion includes a substantially planar electron emission surface; and the conductive member comprises a wire having rectangular cross-section.

18. The electron emitter of claim 17, wherein the rectangular cross-section defines a square shape.

19. The electron emitter of claim 17, wherein the rectangular cross-section defines a ribbon wire.

* * * * *